US006789981B2

(12) United States Patent
Pollack

(10) Patent No.: US 6,789,981 B2
(45) Date of Patent: Sep. 14, 2004

(54) RISER TENSIONING CONSTRUCTION

(75) Inventor: Jack Pollack, Monaco (MC)

(73) Assignee: Single Buoy Moorings, Inc., Marly (CH)

( * ) Notice: Subject to any disclaimer, the term of this patent is extended or adjusted under 35 U.S.C. 154(b) by 0 days.

(21) Appl. No.: 10/335,882

(22) Filed: Jan. 3, 2003

(65) Prior Publication Data

US 2003/0103813 A1 Jun. 5, 2003

Related U.S. Application Data

(62) Division of application No. 09/647,149, filed as application No. PCT/EP99/02049 on Mar. 23, 1999, now Pat. No. 6,517,291.

(30) Foreign Application Priority Data

Sep. 9, 1908 (EP) ..... 98203003
Mar. 27, 1998 (EP) ..... 98200984

(51) Int. Cl.[7] ..... E02D 5/74; E21B 33/038

(52) U.S. Cl. ..... 405/224.4; 405/195.1; 405/223.1; 405/224; 405/224.2; 166/355; 175/5

(58) Field of Search ..... 405/195.1, 223.1, 405/224, 224.1, 224.4; 166/350, 352, 355, 367; 175/5, 7, 8; 114/264–267

(56) References Cited

U.S. PATENT DOCUMENTS 2,908,141 A * 10/1959 Marsh, Jr. ..... 114/293
3,158,206 A 11/1964 Kammerer
3,191,201 A 6/1965 Joubert
3,421,581 A 1/1969 Geijn
3,681,928 A 8/1972 Vicken et al.
3,760,875 A 9/1973 Busking
3,851,492 A 12/1974 Cannon et al.
3,881,695 A 5/1975 Mohlman
3,897,045 A 7/1975 Butler
3,917,006 A 11/1975 Kellner
3,991,837 A 11/1976 Crickmer
4,142,584 A 3/1979 Brewer et al.
4,272,059 A * 6/1981 Noerager et al. ..... 166/355
4,423,983 A 1/1984 Dadiras et al.
4,432,420 A 2/1984 Gregory et al.
4,611,952 A * 9/1986 Saint-M'Leux ..... 405/224
4,616,708 A 10/1986 da Mota
4,690,586 A 9/1987 Oksuzler (List continued on next page.)

FOREIGN PATENT DOCUMENTS

| | | |
|---|---|---|
| EP | 1036914 | 9/2000 |
| FR | 2 128 057 | 3/1971 |
| GB | 873477 | 7/1961 |
| WO | 99 17983 | 6/1999 |
| WO | 99 31345 | 6/1999 |
| WO | 1016458 | * 3/2001 |

*Primary Examiner*—Jong-Suk Lee
(74) *Attorney, Agent, or Firm*—Young & Thompson

(57) ABSTRACT

A vessel includes a riser and/or tendon tensioning construction. A connector, such as an arm or deck structure, is suspended from cables movable relative to cable guides. The connector carries two or more risers and/or tendons extending from a subsea structure to above water level. The free ends of the cables are attached to weights for exerting a tensioning force on the risers, which are substantially decoupled from pitch, roll and heave motions of the vessel.

23 Claims, 12 Drawing Sheets

U.S. PATENT DOCUMENTS 5,135,327 A 8/1992 White et al.
5,427,180 A * 6/1995 dePaiva Leite et al. ..... 166/355
5,439,321 A 8/1995 Hunter
5,479,990 A 1/1996 Peppel
5,678,503 A 10/1997 Poranski, Sr.
5,707,178 A * 1/1998 Srinivasan ..... 405/223.1
5,893,334 A 4/1999 Poranski, Sr.
6,012,873 A * 1/2000 Copple et al. ..... 405/224
6,126,501 A 10/2000 Hooper et al.
6,170,424 B1 1/2001 Boerseth
6,199,500 B1 3/2001 Boseth et al.
6,296,232 B1 10/2001 Roodenburg

* cited by examiner

RISER TENSIONING CONSTRUCTION

This application is a division of application Ser. No. 09/647,149, filed on Sep. 27, 2000 now U.S. Pat. No. 6,517,291. Application Ser. No. 09/647,149 is the national phase of PCT International Application No. PCT/EP99/02049 filed on Mar. 23, 1999 under 35 U.S.C. §371. The entire contents of each of the above-identified applications are hereby incorporated by reference.

BACKGROUND OF THE INVENTION

The invention relates to a vessel comprising a riser or tendon tensioning construction having at least two spaced apart mounting points and a connector carrying two or more risers or tendons which are with one end attached to the seabed and with the other end attached to the connector, the connector being suspended from the mounting points by at least two suspension members which are movably connected to the mounting points, the suspension members being with a first end attached to respective positions on the connector and with their second end to a respective tensioning member for exerting a tensioning force on the risers or tendons.

From U.S. Pat. No. 4,567,842 a mooring system for a floating production vessel is known comprising a riser which is tensioned by a weight type motion compensating system. Herein the tensioning construction comprises a pivotable frame at the bow of the vessel which at one end is provided with a large counterweight near deck level. The known system has as a disadvantage that it takes up a lot of space and that during roll, pitch or heave movements of the vessel the large mass of the tensioning construction can give rise to an unbalance and exerts large forces on the supporting frame structure.

From U.S. Pat. No. 4,272,059 a riser tensioning system is known wherein a riser, such as a drilling riser, is at its upper end provided with a tension ring which is connected via cables to sheaves on the drilling vessel. The sheaves are mounted on the free ends of piston rods of hydraulic cylinders, the second end of the cables being attached to the vessel. Upon heave, roll or pitch of the vessel, the tensional forces on the riser are maintained generally constant by movement of the piston rods against the hydraulic pressure in the cylinders. This system has as a disadvantage that the tensional forces exerted on the riser will vary with the buoyancy of the vessel. In order to obtain a relatively large stroke of the cylinders the cylinders should be relatively long and therefore take up a lot of space, which in view of the moving nature of the cylinders cannot be effectively used. Furthermore, the hydraulic system is relatively complex.

From U.S. Pat. No. 3,681,928 a barge supporting a drilling rig is known, in which a platform is movably suspended from two mounting arms above deck level of the barge. The platform is connected to the seabed via two parallel cables, or tendons, which pass through openings in the platform and through a central well in the barge. By this construction the platform remains in a horizontal position and at a constant height above the seabed when the vessel moves vertically due to wave motion. Under the influence of the dependent counterweights, the cables are kept taut. This construction has as a disadvantage that upon movement of the barge relatively large inertia forces may be exerted on the sheaves by the counter weights, and that large forces are exerted on the cables by the swinging counterweights. Furthermore, the freely swinging counterweights may form an obstruction for personnel on deck of the drilling barge, and take up a lot of space as they should be clear from any structural parts of the barge, especially in situations of high seas.

SUMMARY OF THE INVENTION

It is therefore an object of the present invention to provide a riser and/or tendon tensioning construction which can be used in deep waters using a dry production tree, which consumes relatively little space and which is stable under different motions of the vessel. It is a further object of the present invention to provide a riser tensioning construction which allows attachment of multiple risers while maintaining a substantially equalised tensional force on the risers upon movements of the vessel. It is a further object of the present invention to provide a riser tensioning system which can also function as a stable support platform for production or drilling equipment. It is another object of the present invention to provide a tensioning construction which can be used in deep waters to support a metal pipe, or riser, passing from a sub sea structure to a deck supported on a floating vessel. The risers may convey hydrocarbon well production fluids to production trees on the riser supporting deck, or alternatively be used to convey flow between the sub sea structure and the deck. The upper and lower connections of the risers may be rigid with bending taking by the pipe, or may include pivoting means.

Thereto the riser tensioning construction according to the present invention is characterised in that the tensioning member extends outside the hull of the vessel or through a well in the vessel such as to be located below water level.

By placing the counterweight below water level, the forces exerted by the counterweight on the vessel upon movement thereof are reduced and the motions of the counterweight are damped. Furthermore, location below water level of the counterweight provides for an easy way of varying the tensional force exerted thereby, not only by varying the mass thereof but also by varying the buoyancy.

The riser and/or tendon tensioning construction according to the present invention is particularly useful in deep waters as it allows rigid risers to pass from greath depths to the surface, using only proven components that can take up considerable forces and external pressures. Pipes and flowthrough pivot joints are available for these pressures.

The suspension member may be a cable that is guided along a sheave, but is preferably formed by a pivoting arm, which is less subject to wear compared to a cable-sheave system. The tensioning member according to the present invention may be formed by a counterweight either directly attached to one free end of the pivot arm, or attached to the pivot arm via a cable. The tensioning member may comprise a cable that is attached to the seabed by anchoring means such as a clump weight, a suction anchor or a pile, for exerting a tensioning force on the risers and/or tendons, in which case it is preferred that the cable is elastic, such as for instance a polyester cable. It is furthermore possible that the suspension member and the tensioning member are formed by a single cable which continues along the cable guide means to extend towards the seabed.

It is noted that from WO 98/18673 a mooring system is known in which a cable extends from the seabed towards deck level of the vessel to be directed around a sheave back to a counterweight freely suspended from the cable below sea level, for the reduction of mooring loads attributable to oscillating wave drifts. The tensioning system described therein uses for each mooring line a separate counterweight and is not flexible in case several risers or anchor lines need to be added to the vessel.

In a further embodiment according to the present invention each suspension member is with its first end attached to the connector on one side of a centre line of the vessel, the mounting point of the respective suspension member being located on the other side of the centre line. In case the tensioning member comprises counterweights located above or below water level, placing the weights on the opposite side of the ship with respect to the point in which the suspension member is attached to the connector, an angular compensation for the roll and pitch motions is achieved, which results in little to substantially zero vertical movements of the hanging weights.

In a further embodiment according to the present invention the mounting points comprise at least two spaced apart mounting arms each carrying a cable guide means and a respective cable, the connector being supported by the first ends of the cables, preferably above deck level. In this embodiment the motions of the vessel are completely decoupled from the risers. A substantially constant tensional force is exerted on the risers and/or tedons upon heave, pitch or roll of the vessel. As the mounting arms according to the present invention remain stationary, they do not form an obstruction for the drilling and production equipment on the vessel.

The connector can for instance be formed by a support arm extending between the mounting arms in the length or width direction of the vessel. The support arm, preferably supporting multiple risers, is lowered or raised a small amount that is determined by the elasticity of the risers, at the respective side at which the tension in the riser increases or decreases by lifting or lowering of the counterweights. Besides dynamic forces acting on the counterweights and frictional forces in the cable guide means, the tensional forces on the risers remain substantially constant and are substantially independent of the movements of the vessel. Furthermore, the support arm can be effectively used as, or be part of a stable deck structure for supporting drilling or production equipment, as it will be maintained in a substantially horizontal position by the tensional forces of the risers acting therein.

The riser tensioning construction according to the present invention may be mounted on a turret structure of a vessel around which the vessel can weathervane, at deck level or at keel level thereof. It is also possible to use the present riser tensioning construction in a vessel wherein the cables and counterweights extend in a central well, for instance through the turret.

To prevent lateral motions of the tensioning weight it is possible to provide a weight guiding element on the vessel, for instance near keel level or near the seabed. It is also possible to guide the tensioning weights along the risers, in case a rigid steel casing is used.

BRIEF DESCRIPTION OF THE DRAWINGS

Some embodiments of the riser tensioning construction according to the present invention will, by way of example, be explained in detail with reference to the accompanying drawings. In the drawings.

DESCRIPTION OF THE PREFERRED EMBODIMENTS

Figure 1:
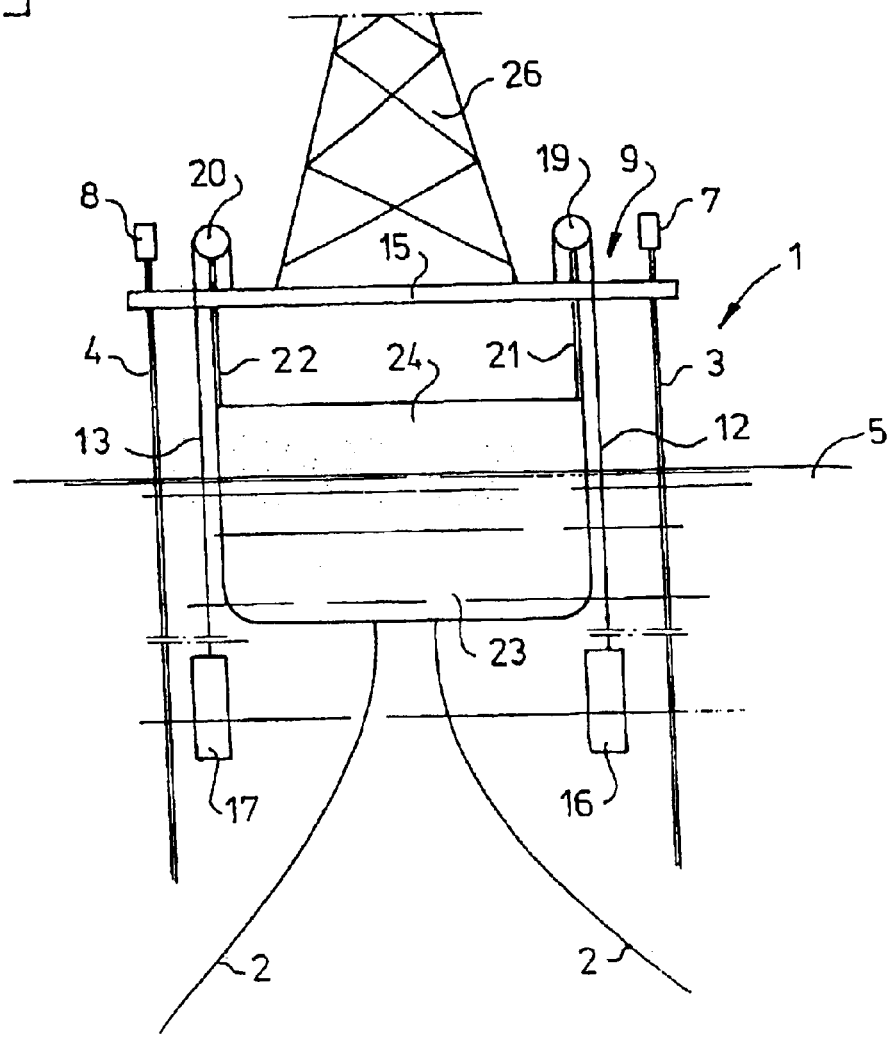
FIG. 1 shows a schematic frontal view of a first embodiment of a vessel comprising the riser tensioning system according to the present invention.

FIG. 1 shows vessel 1, such as for instance a floating storage and production vessel which is moored to the seabed via catenary anchor lines 2. As used herein the word "vessel" is intended to mean any floating construction such as semi-submersibles, floating production vessels, tension leg platforms, barges etc.. The vessel can be anchored to the seabed via anchor lines or ropes or via tendons or tethers. Within the scope of the present invention also vessels are comprised which are connected to the seabed only via one or more risers for the supply of hydrocarbons from the subsea structure to the vessel.

From a subsea well head, which may be at a depth of for instance 1000 or 2000 metres, two hard casing steel risers 3, 4 extend up to above water level 5 and are supported by the buoyancy of the vessel 1. The upper ends 7, 8 of the risers 3, 4 are attached to a tensioning member 9 comprising two cables 12, 13 being at one end attached to a connector such as a transverse support arm or a supporting deck 15 and being at their other end connected to a respective clump weight 16, 17. The cables 12, 13 are guided over fixed position sheaves 19, 20 which are supported on vertical mounting arms 21, 22. The arms 21, 22 are located near the sides of the hull 23 of the vessel 1 such that the cables 12, 13 extend alongside the vessel to below water level 5. Upon rolling and heaving of the vessel, the weights 16, 17 are lifted or lowered. In this way the position of the riser supporting deck 15 and the tensional forces on the risers remain substantially constant, independent of the movements of the vessel. The length of the cables 12, 13 may for instance be between 50 and 2000 metres. The mass of each weight 16, 17 may for instance be about 100 tonnes.

Preferably the transverse supporting arm 15 is part of a supporting deck, for which at least three mounting arms, including the arms 21, 22 and a further mounting arm, which is not shown in the drawing, are provided. Each mounting arm 21, 22 is long enough to space the sheaves 19, 20 and the deck 15 far enough from deck level 24 to avoid contact upon relative movements of the supporting deck 15 and the hull 23. This relative movement would mainly be a combination of the hull response to waves, supporting deck set down due to horizontal drifting of the vessel and/or draft changes of hull 23 due to different loading conditions. Preferably drilling or production equipment 26 is mounted on the supporting deck 15. Flow and communication lines that need to pass from the hull 23 to the support deck 15 will be formed by piping or cabling capable of handling the relative movements between the hull 23 and the supporting deck 15. Manned access between hull 23 and supporting deck 15 will be provided with the flexibility to cope with the relative motions between the deck 15 and hull 23.

Figure 2:
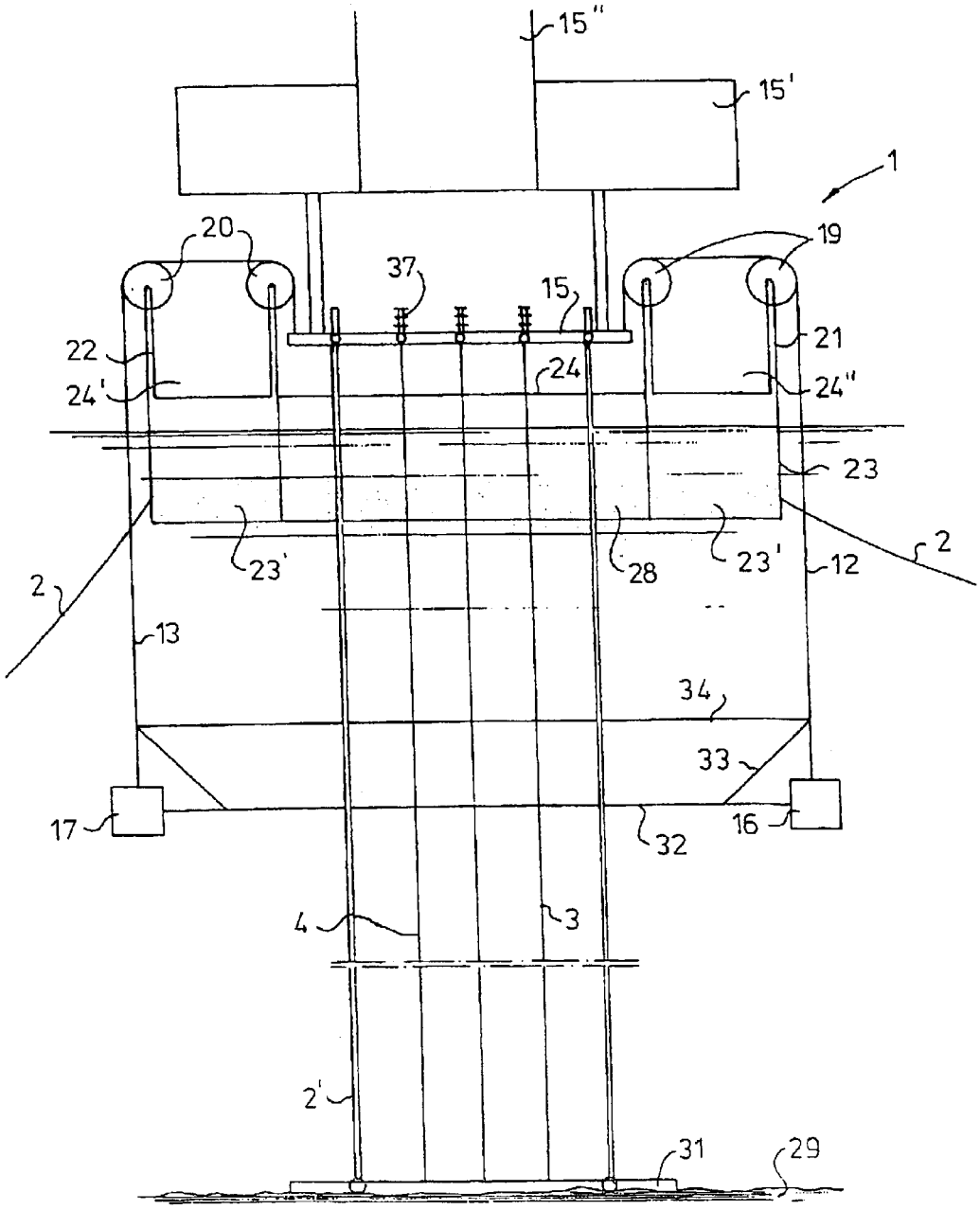
FIG. 2 shows another embodiment of a vessel in the form of a tension leg platform comprising a supporting deck located over a moon pool of the vessel.

In FIG. 2, an embodiment of a vessel 1 is shown which is attached to the seabed 29 via tethers of tendons 2' that are attached to a template 31. In FIG. 2, the elements corresponding to those in FIG. 1 have been given identical reference numerals. The risers 3, 4 and tendons 2' extend through a central well or moon pool 28 in the vessel to be pivotably connected to the supporting deck structure 15. On the deck structure 15 the production trees 37 at the end of the risers are supported. Supported on the deck structure 15 are piping and manifolds 15', the drilling area 15" being located centrally over the trees 37. The parts 23' of the hull 23 located on both sides of the moon pool 28 can be used for oil or gas storage. The deck areas 24' and 24" located below the sheaves 19, 20 can be used for accommodation and processing equipment respectively.

Weights 16, 17, when hanging without guides from cables 13, 14, can swing due to dynamic excitation. A reduction in this swinging can be achieved by interconnections 32, 33, 34 of the weights and cables with one another. Guiding of the weight can also effectively control this dynamic swinging action.

The embodiment of the vessel 1 that is shown in FIG. 2 is attached to the seabed via tethers or tendons 2'. The system shown in FIG. 2 can also have a lateral mooring system 2 of the kind that is shown in FIG. 1 for controlling horizontal motions. The tethers or tendons 2' are primarily used to fix the deck structure 15 at its horizontal position above the hull 23. In this way the deck structure can be initially supported without any riser being attached upon installation thereof.

Figure 3:
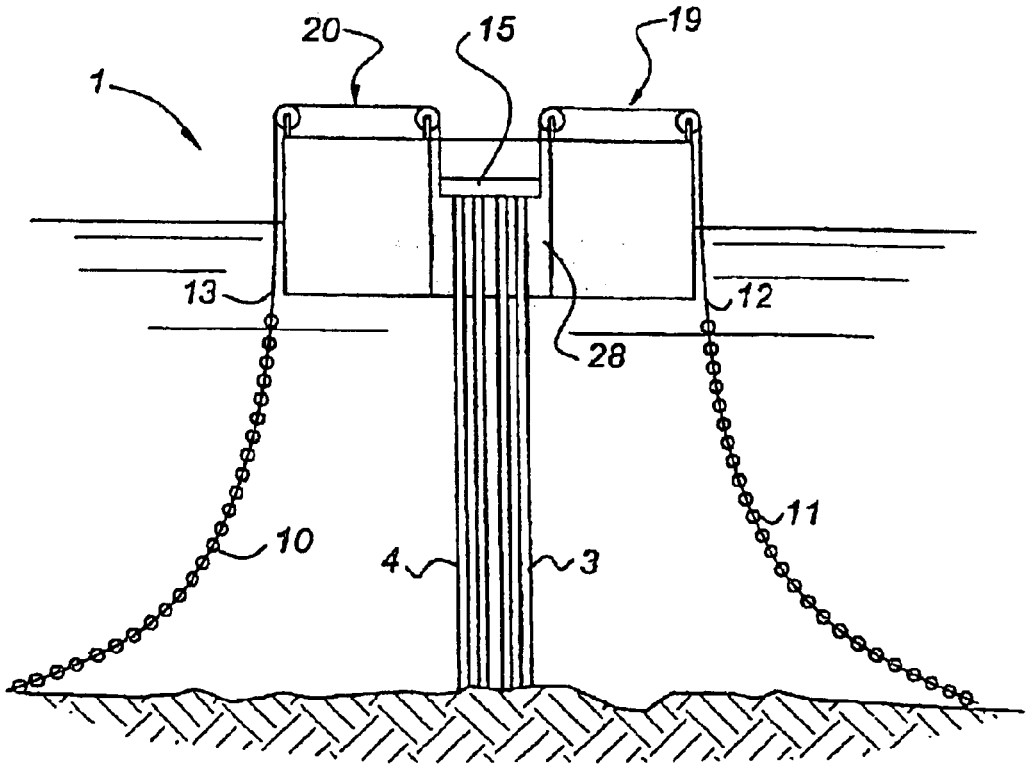
FIG. 3 shows an embodiment wherein the tensioning members are formed by cables having weights distributed along their length.

FIG. 3 shows a barge 1 wherein the tensioning members comprise cables 13, 14 and distributed along their length weights 10, 11. The cables 13, 14 are resting on the seabed 29. Upon motions of the barge 1 the cables 13, 14 will be lowered or raised to maintain the riser supporting deck 15 in a substantially horizontal position. Upon larger excursions of the vessel, the cables 13, 14 will be partially lifted from the seabed 29 so that a progressively increasing tensioning force is generated thereby.

Figure 4:
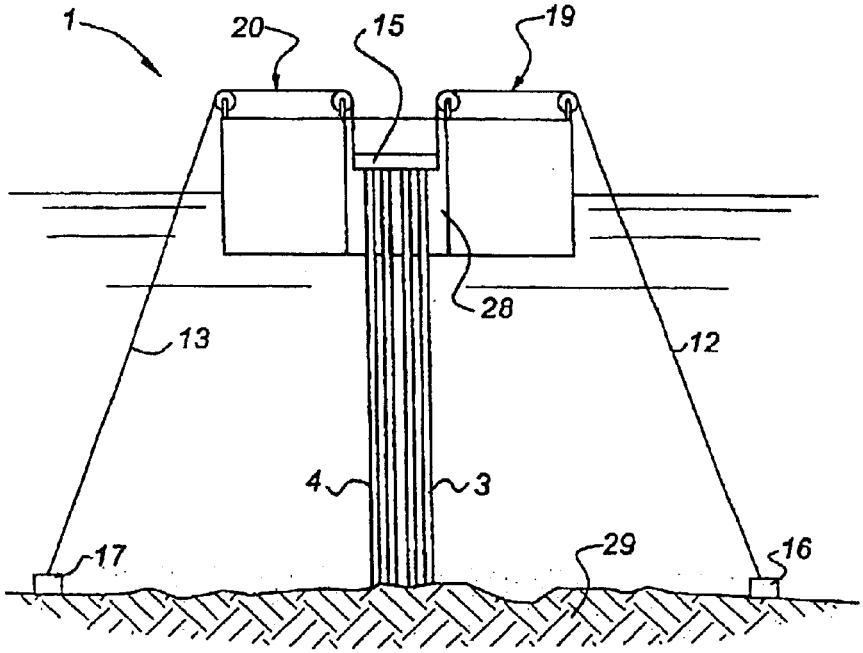
FIG. 4 shows an embodiment wherein the tensioning member comprises an elastic cable anchored to the seabed.

In the embodiment according to FIG. 4, the riser supporting deck 15 is connected to the seabed 29 via elastic cables or lines 12, 13. The cables 12, 13 can be attached to the seabed 29 via weights 16, 17, suction anchors, anchor piles and any other known means. The polyester lines 12, 13 can be combined with steel cables and/or chains. In the present embodiment, the anchoring function of the barge 1 is integrated with the tensioning function of the riser supporting deck 15.

Figure 5:
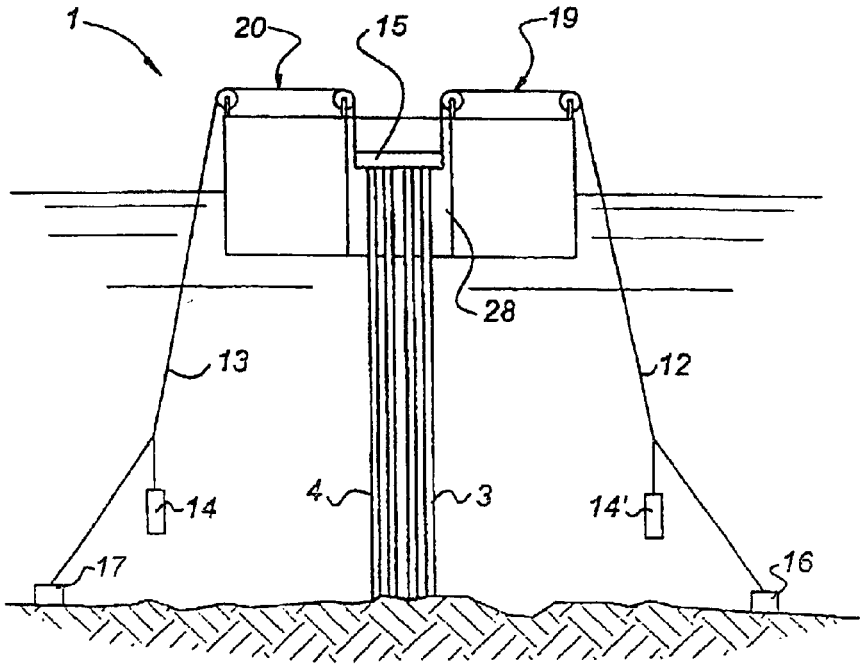
FIG. 5 shows an embodiment wherein the tensioning member is connected to the seabed and is provided with additional tensioning weights.

In the embodiment shown in FIG. 5 additional weights 14, 14' are connected to the elastic cables 12, 13 for providing an additional tensioning force on the riser supporting deck 15.

Figure 6A:
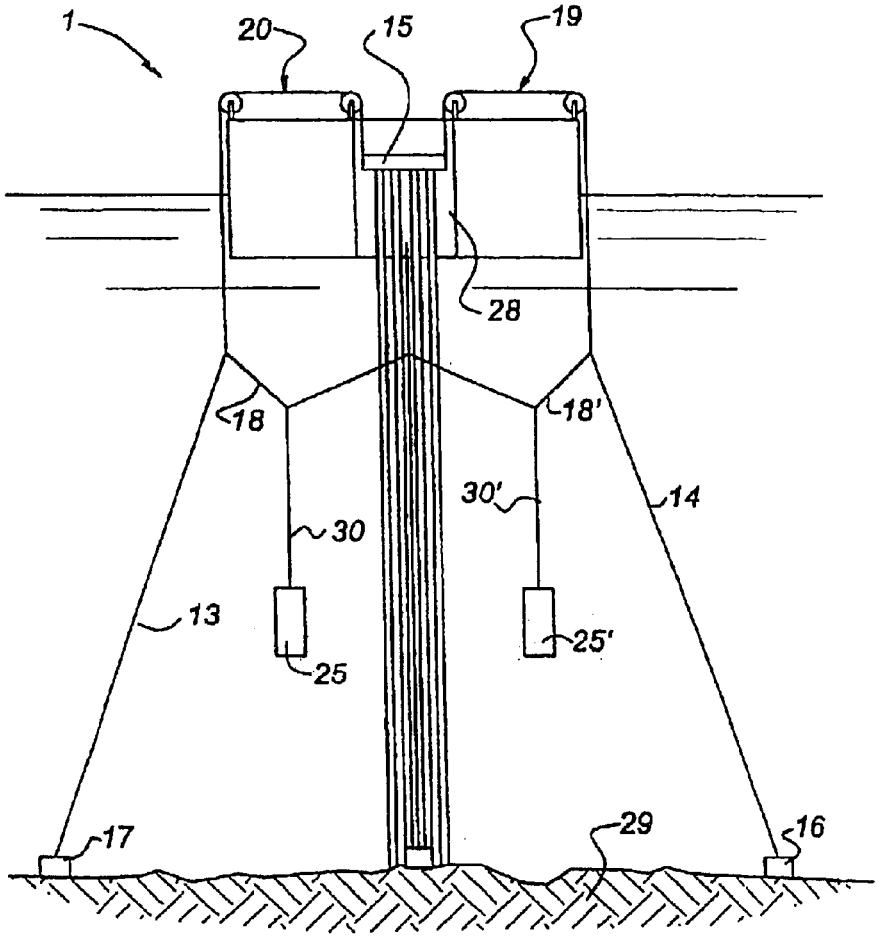
FIGS. 6*a* and 6*b* show a side view and a plan view respectively of the tensioning members being connected to the seabed, the tensioning members being interconnected and provided-with additional tensioning weights.
Figure 6B:
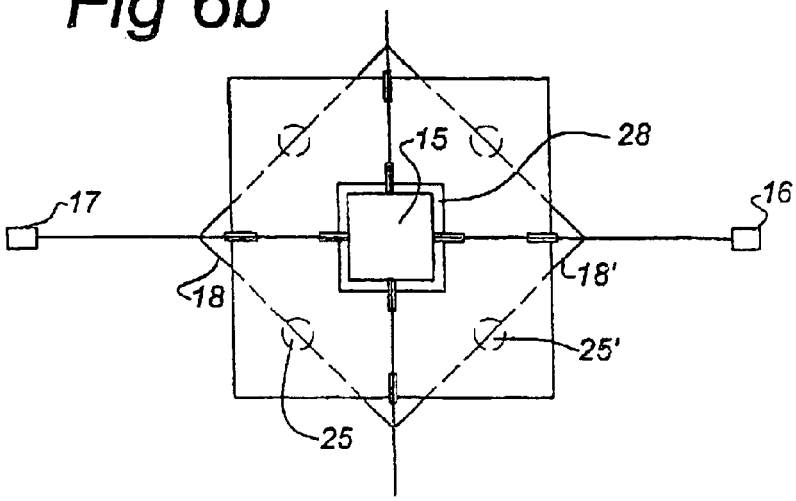

As shown in the embodiments of FIGS. 6*a* and 6*b*, the riser supporting deck 15 is connected to the seabed via four cables 13, 14. The cables are, at a depth of for instances 20 metres below keel level of the vessel 1, interconnected via connecting cables 18, 18', which may extend at angles of between 30 and 40 degrees with the horizontal. Weights 25, 25', which each may have a mass of for instance 200 tonnes, are suspended from cables 30, 30' which may have a length of about 100 metres.

Figure 7:
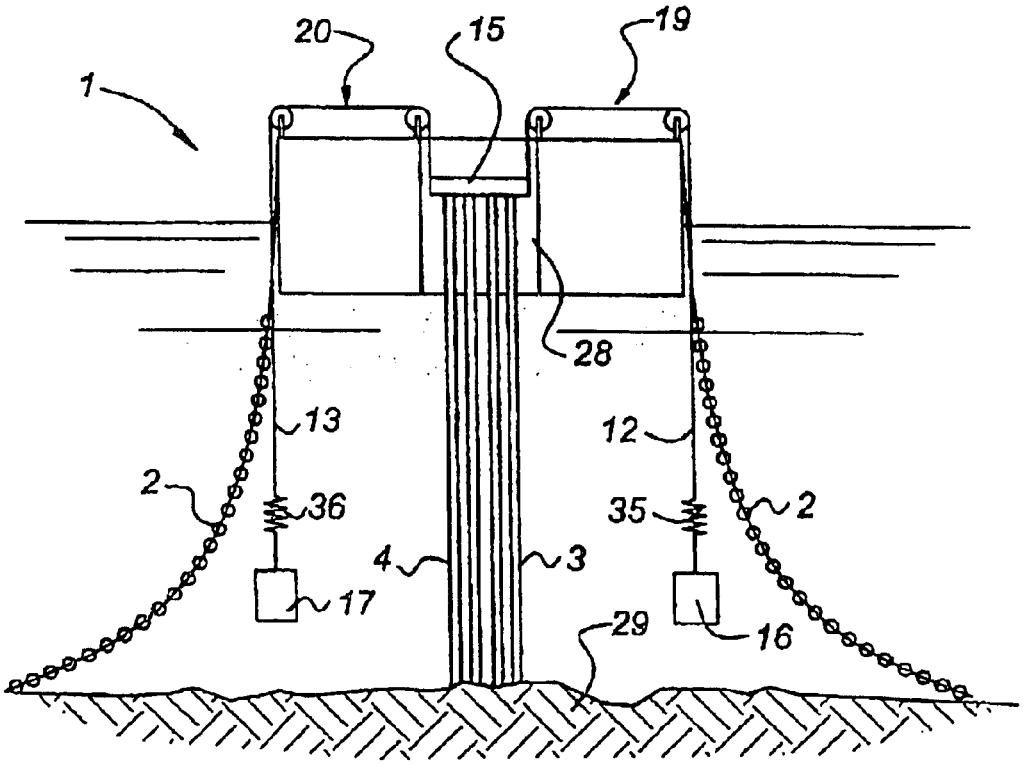
FIG. 7 shows an embodiment wherein the tensioning member comprises an additional spring member for damping oscillations of the tensioning weights.

In the embodiment shown in FIG. 7, the tensioning cables 12, 13 are provided with spring members 35, 36, for instance elastic cable sections, for damping the upward and downward motions of the tensioning weights 16, 17.

Figure 8A:
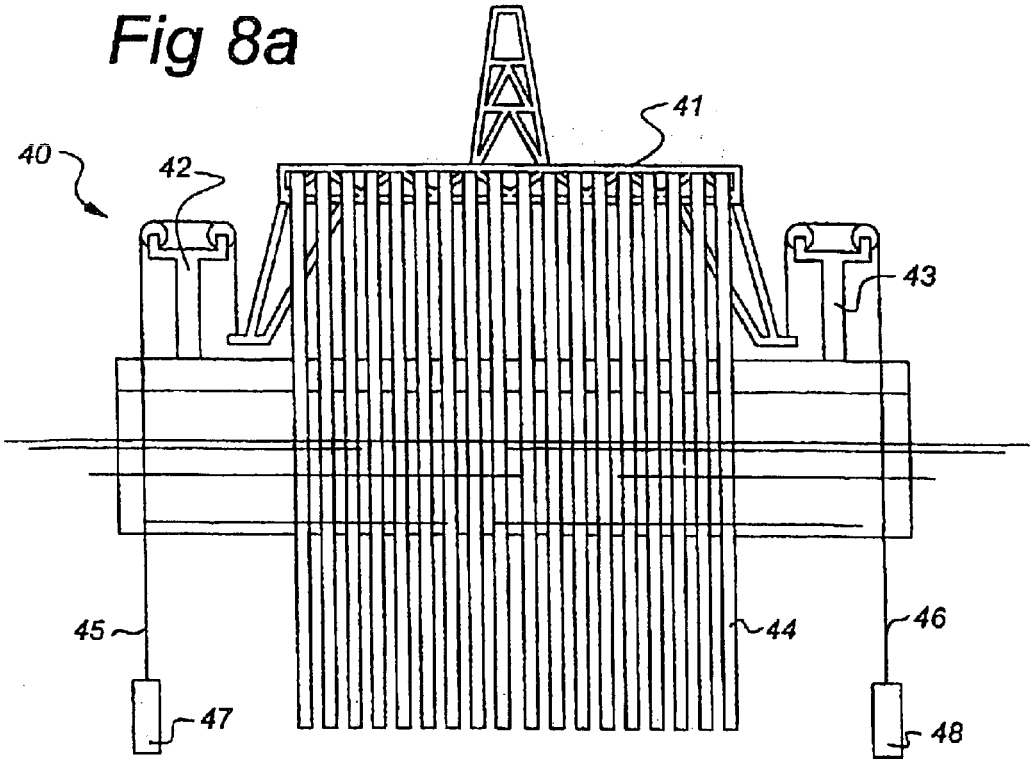
FIGS. 8*a* and 8*b* show a side view and frontal view respectively of a vessel wherein the connector comprises a riser supporting deck, multiple risers being attached on each side of the vessel.
Figure 8B:
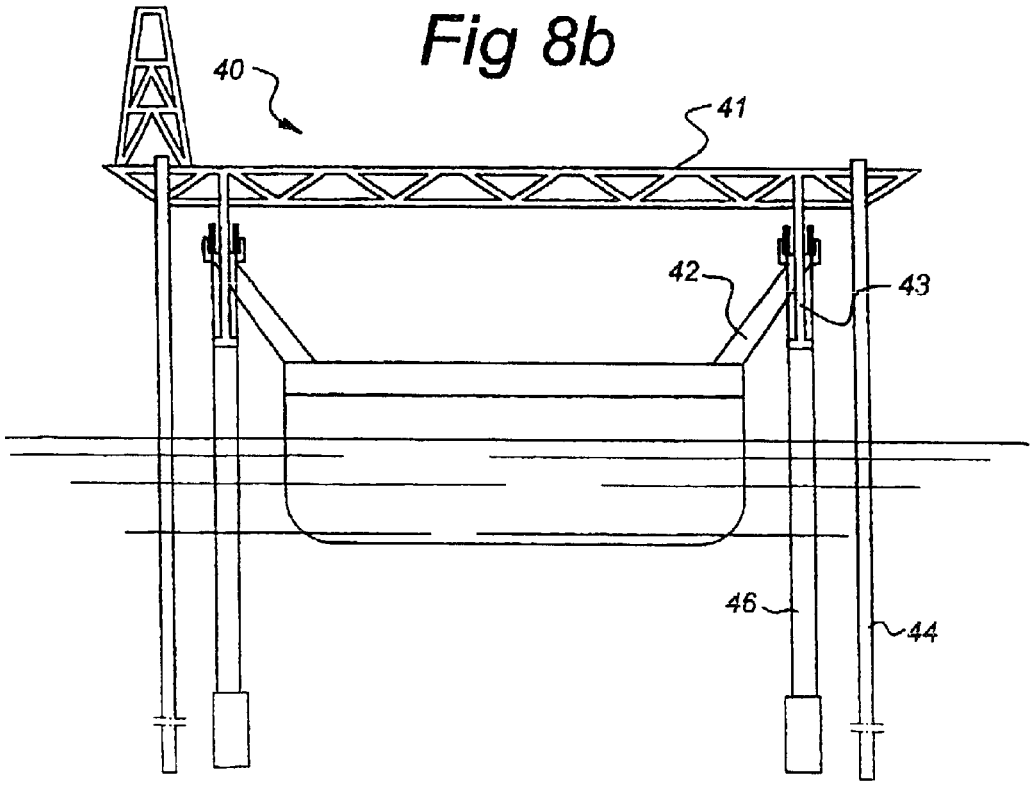

FIGS. 8*a* and 8*b* show an embodiment wherein on each side of the vessel 40 a multiplicity of risers 44 is suspended from the riser supporting deck 41. The riser supporting deck 41 is on each side suspended from two sheaves 42, 43 via tensioning cables 45, 46 and tensioning weights 47, 48.

Figure 9:
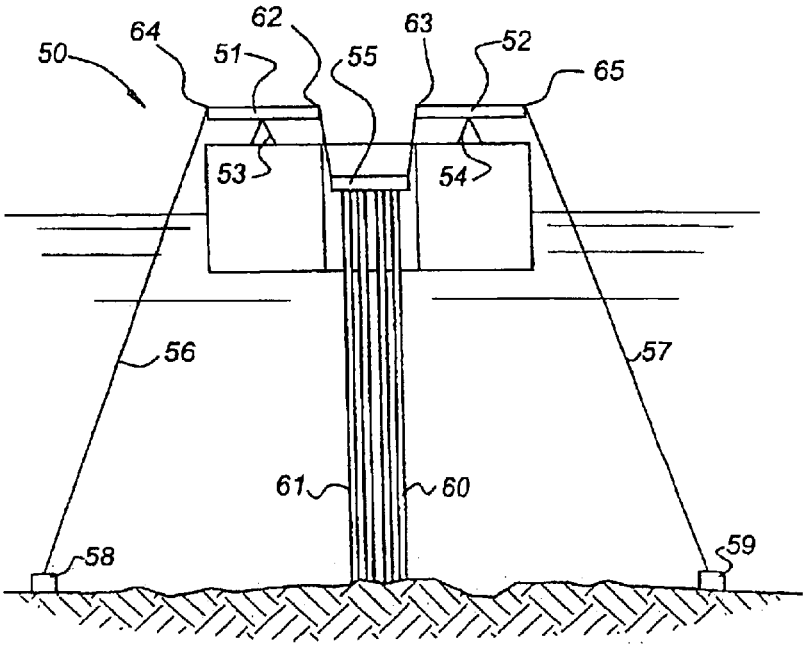
FIG. 9 shows an embodiment wherein the riser supporting deck is suspended from two pivoting arms.

FIG. 9 shows an embodiment of a vessel wherein the riser supporting deck 55 is suspended via cables from two pivot arms 51, 52. The pivot arms 51, 52 are connected to the vessel 50 via pivoting connections 53, 54 above deck level. The pivot arms can be tilted along two parallel pivot axes extending in the direction perpendicular to the plane of the drawing. The facing end parts 62, 63 of the pivot arms 51, 52 are connected to the riser supporting deck 55 via cables, whereas as the second end parts 64, 65 of the pivot arms 51,52 are connected to the seabed via elastic cables 56, 57 and anchoring weights 58, 59. Instead of elastic cables 56, 57 it is also possible to connect counter weights to the end parts 64, 65 of the pivot arms 51, 52. Compared to constructions wherein the supporting deck 55 is suspended from sheaves, the pivoting arms show relatively little wear and therefore have an increased lifetime and reduced maintenance.

Figure 10:
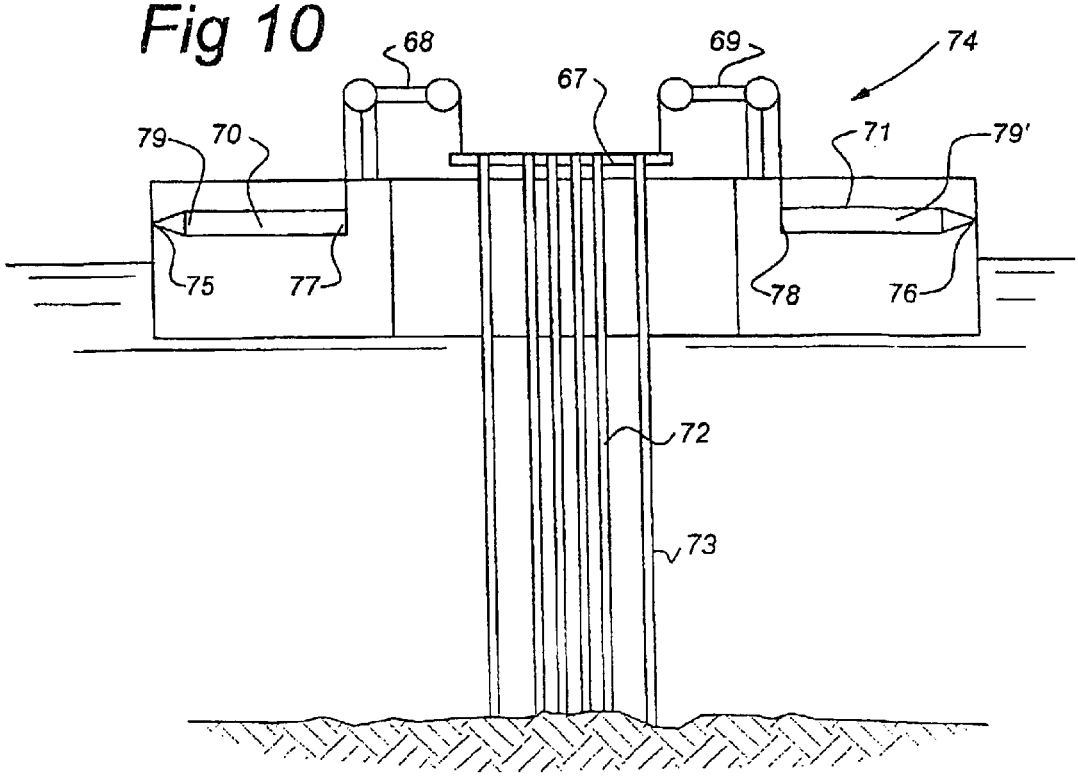
FIG. 10 shows an embodiment wherein the riser supporting deck is suspended by a combination of sheaves and pivoting arms.

In the embodiment shown in FIG. 10, the riser supporting deck 67 is supported by cables which are connected to pivot arms 70, 71 via sheaves supported on mounting arms 68, 69. The pivot arms 70, 71 are with their free ends 77, 78 connected to the riser supporting deck 67 via cables, running along the sheaves. The pivot arms 70, 71 are on one side 79, 79' side connected to pivot points 75, 76 on the the vessel (74) and may be comprised of A-frame type constructions to provide a tensioning force on the risers 72 and tendons 73 that are connected to the riser supporting deck 67.

Figure 11A:
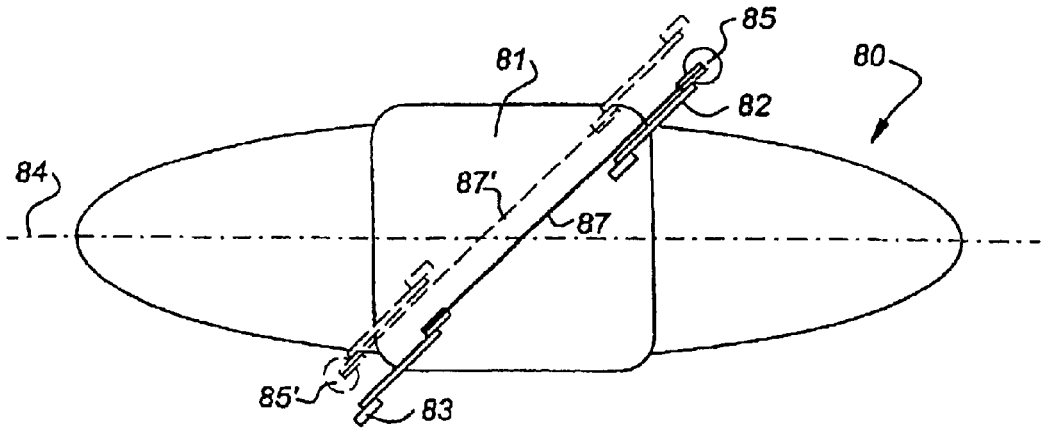
FIGS. 11*a* and 11*b* show a top view and a side view respectively of an embodiment wherein the riser tensioning weight and the attachment point of the tensioning cable to the riser supporting deck are located at opposite sides of the centre line of the vessel.
Figure 11B:
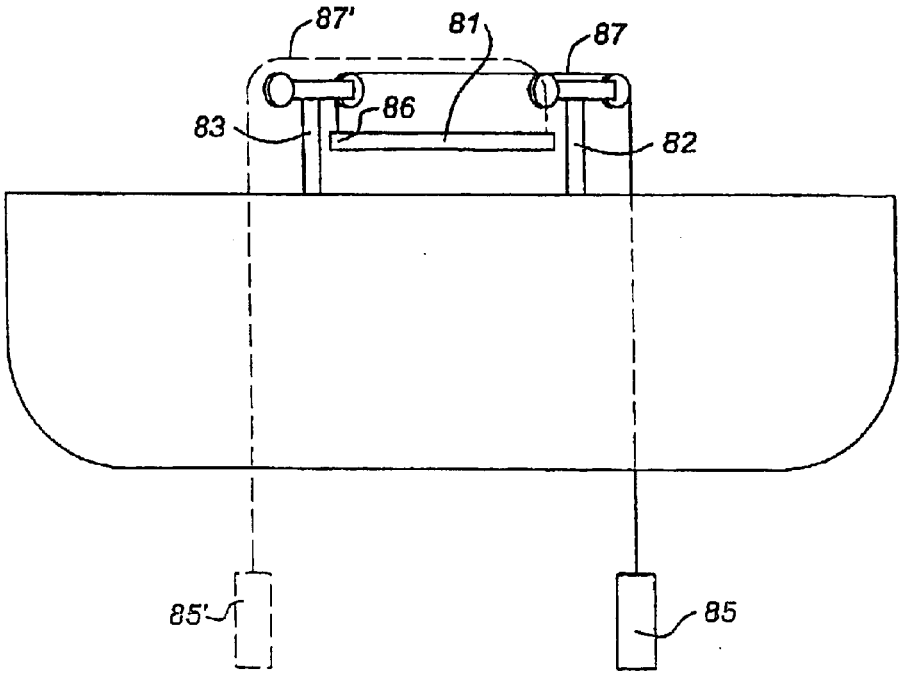

FIG. 11*a* shows a top view of a vessel 80 wherein the riser supporting deck 81 is suspended from first and second sheaves 82, 83 that are located on opposite sides of the longitudinal centre line 84. The tensioning weights 85, 85' and the attachment points 86, 86' of the cables 87, 87' are located on opposite sides of the centre line 84 such that upon rolling of the vessel around the centre line 84 the motion of the weights 85, 85' is compensated by the movement of the sheaves 82, 83. Upon rolling of the vessel around the longitudinal centre line 84 in the direction of the sheave 82, the weight 85 is lowered such that the tension in cable 87 decreases. The tension in the opposite cable 87' will increase as the counterweight 85' is lifted such that the side of the riser supporting deck 81 that is attached to cable 87' will be raised. The side of the deck attached to cable 87 will be lowered and weight 85 will be raised over substantially thevdistance corresponding with the height by which the weight 85 was lowered bacause of downward motion of the sheave 82. As the construction according to FIGS. 11*a* and 11*b* substantially reduces the motion of the weights 85, 85', wear of the cables 87, 87' and sheaves 82, 83 is strongly reduced as is the dynamic load on the riser supporting deck 81.

Figure 12:
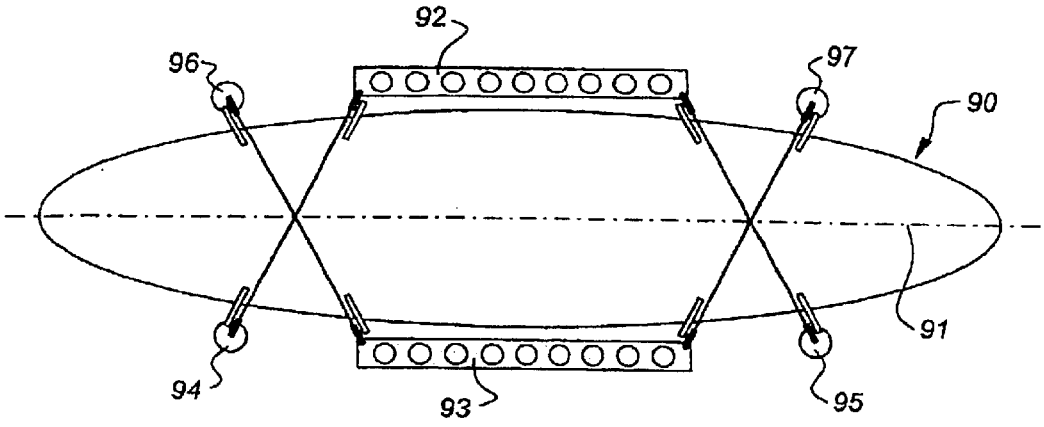
FIG. 12 shows a top view of an embodiment wherein two riser supporting decks and their tensioning weights are located on opposite sides of the longitudinal centre line of the vessel.

FIG. 12 shows an embodiment wherein a vessel 90 carries two riser supporting decks 92, 93 which are each connected to respective counterweights 94, 95 and 96, 97 which are located on opposite sides of the longitudinal centre line 91 for reduction of the vertical motion of the tensioning weights caused by angular motion of the vessel. Placing the counterweights 94, 95, 96, 97 further away from the longitudinal centre line 91, further reduces variation in tension in the cables attached to the riser supporting decks 92, 93.

Figure 13:
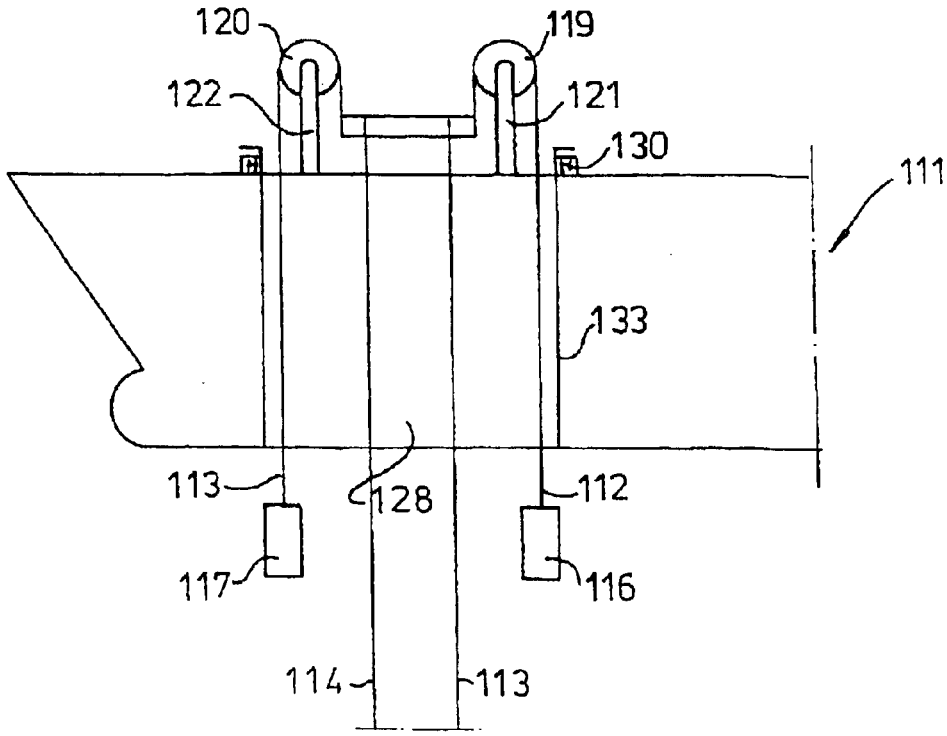
FIG. 13 shows an embodiment of a vessel comprising a riser tensioning construction extending through the turret.

FIG. 13 shows another embodiment according to the present invention wherein the mounting arms 121, 122 carrying the sheaves 119, 120 are placed near a central well 128 extending through the hull of the vessel 111. The mounting arms 121, 122 may be mounted on a bearing structure 130 of a turret 133 that will allow the vessel to weathervane or rotate with respect to the mounting arms. The cables 112, 113 extend through the well 128 to below keel level of the vessel.

The cables 112, 113 moving over sheaves 119, 120 may after a certain period require replacement. To not disrupt the workings of the riser tensioning system multiple cables 112, 113 and/or weights 116, 117 giving redundant stability to deck 115 would be used in a way that temporary removal of one weight for cable maintenance/replacement does not greatly affect the stability or tension of the riser system. Multiple cables can also be connected to the same weight such that replacement/failure does not affect the tensioning of deck 115. This also assures the unexpected failure of one or more cables 112, 113 does not cause a failure of the riser system.

Figure 14:
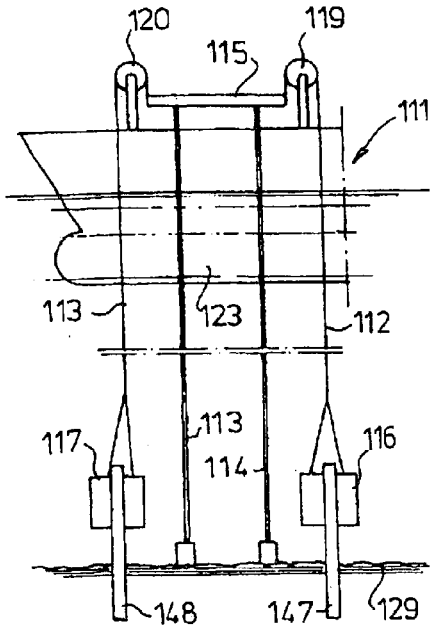
FIGS. 14, 15 and 16 show different embodiments of weight guiding systems for preventing lateral movements of the counterweights.
Figure 15:
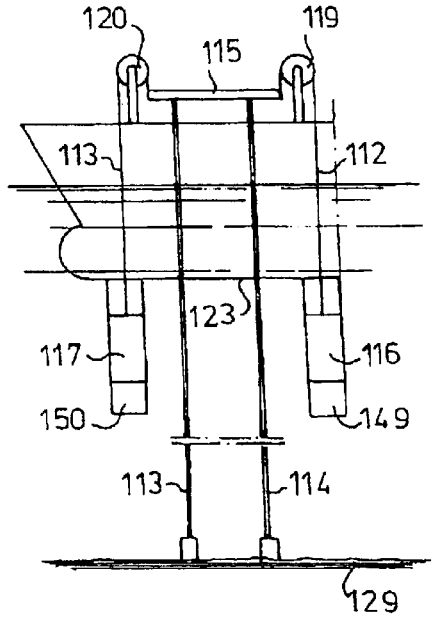

FIG. 14 shows an embodiment wherein the cables 112, 113 extend close to the seabed 129. Two weight guiding elements 147, 148 such as for instance piles, are placed in the seabed and extend through holes in the weights 116, 117 such that these can vertically slide along the piles 147, 148. Hereby lateral movement of the weights 116, 117 is prevented such that they cannot contact the risers 113, 114. FIG. 15 shows an embodiment wherein the weight guiding elements are formed by shafts or cages 149, 150 connected to the vessel 111 near keel level 123. The weights 116 and 117 can slide up and down in the shafts or cages 149,150.

Figure 16:
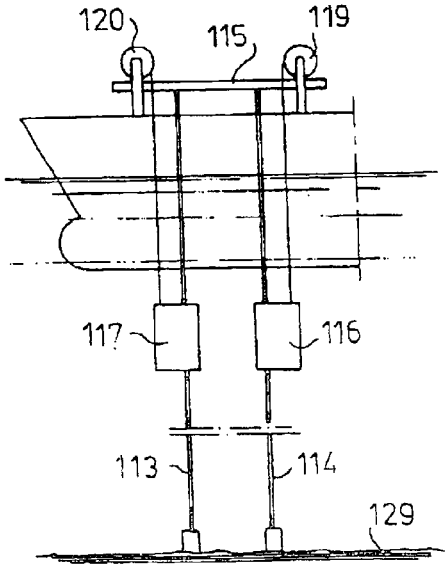

FIG. 16 shows an embodiment wherein the weights 116 and 117 are provided with a throughbore and are placed around the risers 113, 114 to prevent lateral movement of the weights.

Although it has been shown in the previous figures that the weights at the end of cables 112, 113 are clump weights, it is also envisaged that these weights may be formed by other means, such as for instance chain parts which may be 500 metres long, or other types of weights. Furthermore, the cables 112, 113 may be formed by steel cables, wire rope cables, polyester lines, chains or combinations thereof.

The riser and/or tendon tensioning construction according to the present invention can be easily installed by transporting the riser supporting deck on the vessel to the installation site, installation of the mooring lines (which is optional), suspending the deck from the vessel at the desired elevation above sea level, intallation of the risers and/or tendons between the deck and the seabed, and tensioning the tensioning lines, for instance by connecting tensioning weights to these lines.

Although the present invention has been illustrated in the examplary drawings by means of an offshore hydrocarbon transport or production system, it can also be used to provide a stabilised deck structure for semi-submersible constructions, floating gangways, floating docks, floating airstrips, floating bridges, artificial islands etc.

What is claimed:

1. A vessel (1) comprising a riser or tendon tensioning construction having at least two spaced apart mounting points (19, 20) and a connector (15) carrying two or more risers or tendons (3,4) which are with one end attached to the seabed and with the other end attached to the connector (15), the connector (15) being suspended from the mounting points by at least two suspension members (12,13) which are movably connected to the mounting points (19,20), the suspension members (12, 13) being with a first end attached to respective positions on the connector (15) and with their second end to a respective tensioning member (16,17) for exerting a tensioning force on the risers or tendons, wherein the tensioning member (16,17) extends one of outside the hull (23) of the vessel and through a well (28) in the vessel so as to be at least substantially located below water level, and wherein the suspension members and/or their respective tensioning members are below water level mutually connected for reducing swinging motions of the tensioning members.

2. The vessel (1,80) according to claim 1, wherein the suspension member (12,13; 87,87') comprises a cable, the mounting points (19,20; 82,83), comprising cable guide means, and wherein the cables are movably guided along the cable guide means.

3. The vessel according to claim 1, wherein the tensioning members comprise a cable, connected to a weight, the vessel having a central well (28) wherein the cables (12,13) and the weights (16,17) are placed.

4. The vessel according to claim 1, wherein the connector (15) comprises an arm or a deck structure, carrying the risers and/or tendons.

5. The vessel according to claim 1 comprising flexible piping and/or cabling for flow and communication between the deck structure (15) and a hull (23) of the vessel.

6. The vessel according to claim 1 comprising flexible access ways between the deck structure (15) and the hull (23) of the vessel.

7. The vessel according to claim 1, wherein the vessel comprises a storage tank (23') and a connection between the riser on the transverse arms or deck structure (15) and the storage tank (23') for passing flow from the deck structure (25) to said storage tank (23').

8. The vessel according to claim 1, wherein the vessel comprises a turret (33) around which the vessel can weathervane, the mounting points being located on the turret.

9. The vessel according to claim 1, wherein the riser comprises a rigid metal riser.

10. The vessel according to claim 1, wherein the weight comprises adjustable buoyancy or weight means for varying the buoyancy or the mass of the weight.

11. The vessel according to claim 1, wherein the vessel comprises multiple tensioning members such that the riser tensioning construction remains functional upon failure or replacement of at least one tensioning member.

12. A vessel comprising:

two cables and two spaced apart cable guide means that are each for guiding a respective one of said cables, each of said cables being movable relative to said respective cable guide means and having a respective tensioning member attached thereto outside a hull of the vessel, each said tensioning member being in the water below water level; and a connector carrying at least two risers or tendons that each have one end attached to the seabed and another end attached to said connector, said connector being suspended from said cable guide means by said cables, said cables being attached to said connector and exerting a tensioning force on said at least two risers or tendons.

13. The vessel of claim 12, wherein each said tensioning member comprises a weight suspended from a respective one of said cables above the sea bed.

14. The vessel of claim 12, wherein each said tensioning member is attached to the sea bed.

15. The vessel of claim 12, wherein said connector comprises a deck structure carrying said risers or tendons.

16. The vessel of claim 15, further comprising flexible piping or cabling for flow and communication between said deck structure and the hull of the vessel.

17. The vessel of claim 15, further comprising flexible access ways between said deck structure and the hull of the vessel.

18. The vessel of claim 12, further comprising a storage tank and a connection between said risers or tendons and the storage tank.

19. The vessel of claim 12, further comprising a turret around which the vessel weathervanes, said cable guide means points being located on said turret.

20. The vessel of claim 12, wherein said risers or tendons comprise a rigid metal riser.

21. The vessel of claim 12, wherein said tensioning member comprises adjustable buoyancy means for varying one of buoyancy and mass of said tensioning means.

22. The vessel of claim 12, further comprising multiple said tensioning members so that the vessel remains functional upon failure or replacement of at least one said tension member.

23. The vessel of claim 12, wherein said cables and/or said tensioning members are mutually connected below water level for reducing swinging motions of said tensioning members.

* * * * *